US009123297B2

(12) United States Patent
Tsuge

(10) Patent No.: US 9,123,297 B2
(45) Date of Patent: Sep. 1, 2015

(54) DRIVING METHOD OF DISPLAY APPARATUS

(71) Applicant: PANASONIC CORPORATION, Osaka (JP)

(72) Inventor: Hitoshi Tsuge, Osaka (JP)

(73) Assignee: JOLED INC, Tokyo (JP)

( * ) Notice: Subject to any disclaimer, the term of this patent is extended or adjusted under 35 U.S.C. 154(b) by 46 days.

(21) Appl. No.: 14/036,077

(22) Filed: Sep. 25, 2013

(65) Prior Publication Data

US 2014/0022288 A1 Jan. 23, 2014

Related U.S. Application Data

(63) Continuation of application No. PCT/JP2012/005004, filed on Aug. 7, 2012.

(30) Foreign Application Priority Data

Aug. 9, 2011 (JP) ..... 2011-173515

(51) Int. Cl.
*G09G 5/10* (2006.01)
*G09G 3/32* (2006.01)

(52) U.S. Cl.
CPC ..... *G09G 3/3258* (2013.01); *G09G 3/3233* (2013.01); *G09G 3/3291* (2013.01); *G09G 2300/0819* (2013.01); *G09G 2300/0852* (2013.01); *G09G 2310/0262* (2013.01); *G09G 2320/0252* (2013.01); *G09G 2320/045* (2013.01)

(58) Field of Classification Search
CPC . G09G 3/3233; G09G 3/3258; G09G 3/3291; G09G 2300/0819; G09G 2300/0852; G09G 2310/0262; G09G 2320/045; G09G 2320/0252
USPC ..... 345/76–82, 211, 212, 690, 691; 365/145; 349/41; 315/172
See application file for complete search history.

(56) References Cited

U.S. PATENT DOCUMENTS 8,780,022 B2 * 7/2014 Toyomura et al. ..... 345/78
8,786,587 B2 7/2014 Kang et al.
8,907,870 B2 12/2014 Kang et al.

(Continued)

FOREIGN PATENT DOCUMENTS

CN 101908316 A 12/2010
JP 2006-208746 A 8/2006

(Continued)

OTHER PUBLICATIONS

International Search Report issued in International Patent Application No. PCT/JP2012/005004; 4 pages.

(Continued)

*Primary Examiner* — Prabodh M Dharia
(74) *Attorney, Agent, or Firm* — McDermott Will & Emery LLP

(57) ABSTRACT

A method for driving a display apparatus including a current light emitting device which allows a threshold voltage of a driving transistor to be detected independently of an image signal voltage Vsg (j), such that a writing period of the display apparatus can be shortened. The writing period T3 of the display apparatus is larger than a sum of a time needed for determining image signal voltage Vsg (j) and a time needed for charging a first capacitor which is coupled to a gate of the driving transistor.

3 Claims, 8 Drawing Sheets

(56) References Cited

U.S. PATENT DOCUMENTS

| | | | | |
|---|---|---|---|---|
| 9,001,012 | B2 | 4/2015 | Yumoto | |
| 2005/0057580 | A1* | 3/2005 | Yamano et al. | 345/690 |
| 2006/0221662 | A1* | 10/2006 | Park et al. | 365/145 |
| 2007/0273620 | A1 | 11/2007 | Yumoto | |
| 2008/0143264 | A1* | 6/2008 | Minami et al. | 315/169.3 |
| 2008/0150846 | A1* | 6/2008 | Chung | 345/80 |
| 2009/0115707 | A1 | 5/2009 | Park et al. | |
| 2009/0201231 | A1* | 8/2009 | Takahara et al. | 345/76 |
| 2010/0149152 | A1* | 6/2010 | Yamamoto et al. | 345/211 |
| 2010/0149167 | A1* | 6/2010 | Hasegawa et al. | 345/213 |
| 2010/0265166 | A1 | 10/2010 | Kang et al. | |
| 2010/0309187 | A1 | 12/2010 | Kang et al. | |
| 2013/0099692 | A1* | 4/2013 | Chaji et al. | 315/224 |
| 2013/0328951 | A1* | 12/2013 | Yamashita et al. | 345/690 |
| 2013/0335399 | A1* | 12/2013 | Tsuge | 345/212 |
| 2014/0049570 | A1* | 2/2014 | Tanikame et al. | 345/690 |
| 2014/0285408 | A1 | 9/2014 | Yumoto | |
| 2014/0320384 | A1 | 10/2014 | Yumoto | |

FOREIGN PATENT DOCUMENTS

| | | | |
|---|---|---|---|
| JP | 2007-316454 | A | 12/2007 |
| JP | 2008-051990 | A | 3/2008 |
| JP | 2009-169145 | A | 7/2009 |
| JP | 2009-276796 | A | 11/2009 |
| JP | 2010-113101 | A | 5/2010 |
| JP | 2010-122320 | A | 6/2010 |
| JP | 2010-250260 | A | 11/2010 |
| KR | 10-2007-0120861 | A | 12/2007 |
| KR | 10-2010-0115062 | A | 10/2010 |

OTHER PUBLICATIONS

Korean Notice of Allowance issued in counterpart Korean Patent Application No. 10-2013-7027997 on Jan. 28, 2015; 2 pages in Korean language.

Chinese Office Action and Search Report issued in corresponding Chinese Patent Application No. 201280019241.X, mailed on Apr. 17, 2015; 6 pages with English translation of Search Report.

* cited by examiner

DRIVING METHOD OF DISPLAY APPARATUS

RELATED APPLICATIONS

This application is a Continuation of International Patent Application No. PCT/JP2012/005004, filed on Aug. 7, 2012, which claims the priority of Japanese Patent Application No. 2011-173515 filed on Aug. 9, 2011, the disclosures of which are incorporated herein by reference.

TECHNICAL FIELD

The present disclosure relates to a driving method of an active-matrix display apparatus employing a current light emitting device.

BACKGROUND

An organic EL (electroluminescence) display apparatus has a large number of arrayed self luminous organic EL devices. The EL display apparatus does not require a backlight and does not have any viewing angle restrictions. Accordingly, it has been developed as a next generation display apparatus.

The organic EL device is a current light emitting device which can control luminance in response to an amount of current flow. Methods for driving the organic EL device include a simple-matrix method and an active-matrix method. The simple-matrix method allows a pixel circuit to be made simple, but it is difficult to achieve a large-sized and high definition display. For this reason, the active-matrix organic EL display apparatus, which has driving transistors for every pixel circuit, has been mainly used in recent years.

The driving transistor and its peripheral circuit are formed generally by TFT (Thin Film Transistors) made of polysilicon or amorphous silicon. Although TFT has the disadvantage of a high threshold voltage fluctuation due to its low mobility, the TFT is suitable for a large-sized organic EL display apparatus because large sized TFT is easy to make and the cost of TFT is low. Further, a method for overcoming the disadvantage (fluctuation of the threshold voltage) has been studied by improving a pixel circuit. For example, Japanese Patent Application Publication JP2009-169145A1 describes an organic EL display apparatus which compensates the threshold voltage of the driving transistor.

The compensation of threshold voltage is performed as follows. First, a voltage larger than the threshold voltage is applied between a gate and source of the driving transistor in order to generate a current-flow in the driving transistor and to discharge a capacitor connected between the gate and the source of the driving transistor. The current in the driving transistor stops flowing when a terminal to terminal voltage of the capacitor (i.e. voltage between two terminals of the capacitor) decreases to the threshold voltage of the driving transistor. This terminal to terminal voltage is added to an image signal and an image is thereby displayed independently of the threshold voltage of the driving transistor.

If the terminal to terminal voltage of the capacitor is much higher than the threshold voltage, the capacitor is discharged rapidly because the current flowing in the driving transistor is large. However, as the terminal to terminal voltage of capacitor decreases toward the threshold voltage, the amount of current flowing in the driving transistor decreases. As a result, the discharging speed of the capacitor becomes slow. Thus, a long time is required before the terminal to terminal voltage of capacitor falls to the threshold voltage of the driving transistor. Practically, 10-100 micro-seconds, for example, may be required.

However, according to the pixel circuit and the driving method described in JP2009-169145A1, a data line for supplying an image signal is used for compensating the threshold voltage. This limits the time available for the writing operation, and makes it difficult to achieve a large-sized or high definition display apparatus having a large numbers of pixels.

SUMMARY

The present disclosure relates to a driving method of a display apparatus. The display apparatus has a plurality of arrayed pixel circuits. Each of the pixel circuits includes:

a current light emitting device;

a driving transistor supplying current to the current light emitting device;

a first capacitor having a first terminal connected to a gate of the driving transistor;

a second capacitor connected between a second terminal of the first capacitor and a source of the driving transistor;

a first switch applying a reference voltage to the gate of the driving transistor;

a second switch supplying an image signal voltage to a node at which the first and the second capacitors are connected;

a third switch supplying an initialization voltage to the source of the driving transistor, and a fourth switch configured to short circuit the first capacitor.

The driving method comprises:

(a) dividing one-frame period into an initializing period, a threshold detection period, a writing period, and a luminescence period;

(b) applying, in the initializing period, a differential voltage between the reference voltage and the initializing voltage to the second capacitor by setting a second switch OFF and setting the first, third and fourth switches ON;

(c) reducing, in the threshold detection period, the voltage of the second capacitor, by closing current path including the second capacitor and the driving transistor, where the current path is closed by setting the second and third switches OFF and setting the first and fourth switches ON;

(d) applying, in the writing period, a differential voltage between the reference voltage and the image signal voltage to the first capacitor by setting the third and fourth switches OFF and setting the first and second switches ON, and (e) applying, in the luminescence period, a current to the driving transistor and the current light emitting device corresponding to the image signal voltage by setting the first, second, third and fourth switches OFF.

The foregoing structure allows performing a writing operation at a high speed, and compensating the threshold value voltage of the driving transistor.

DETAILED DESCRIPTION

An embodiment of a display apparatus of the present disclosure will be described with reference to the accompanying drawings. Hereafter, as an example of the display apparatus, an active-matrix organic EL display apparatus that emit light from EL devices (which is an example of current light emitting devices) using a driving transistor is described. However, the present disclosure is not limited to the organic EL display apparatus. The present disclosure may be applicable to various active-matrix display apparatus employing arrayed pixel circuits, each having a current light emitting device that controls luminance in response to an amount of current flow and a driving transistor which supplies current to the current light emitting device.

Figure 1:
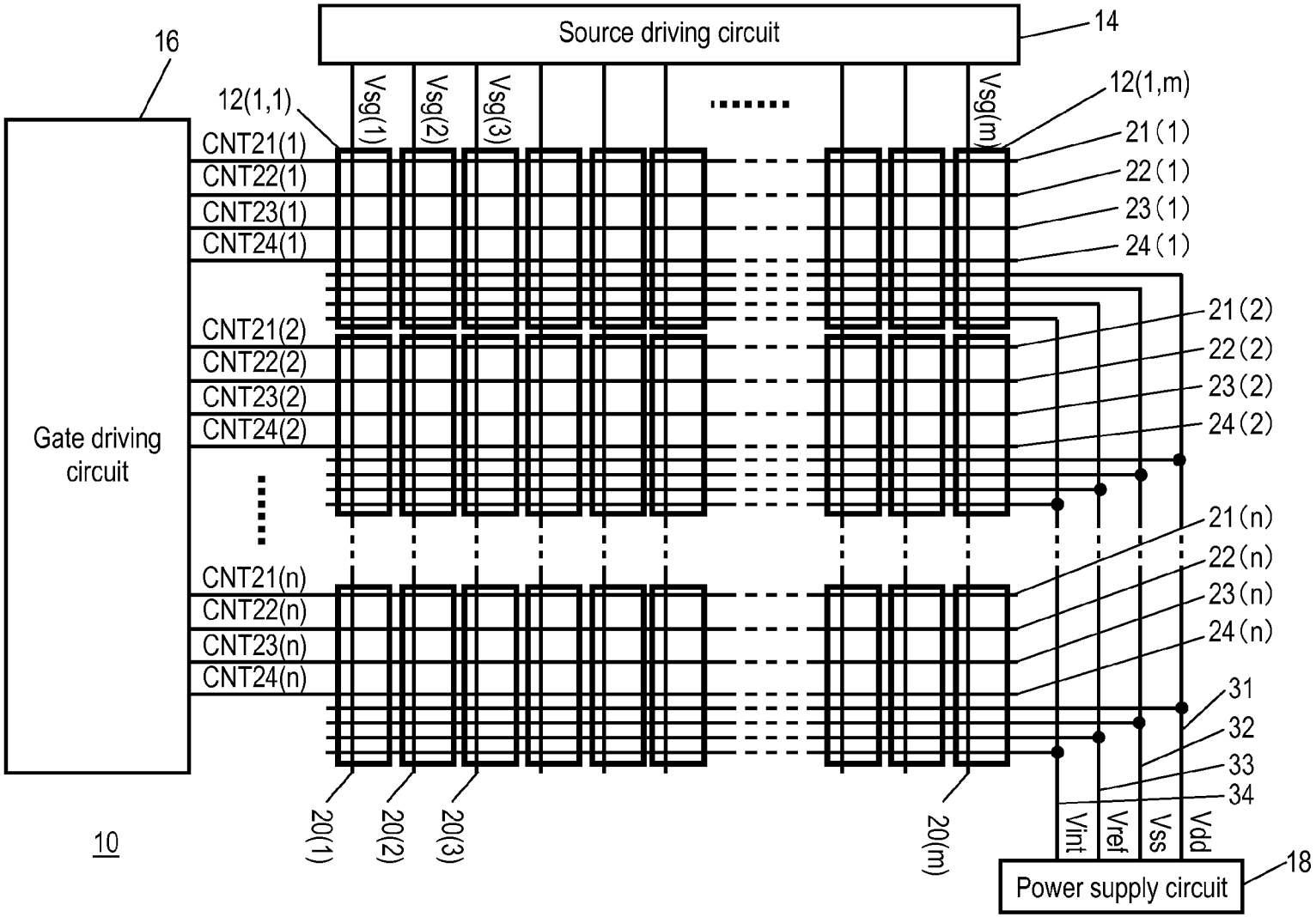
FIG. 1 is a block diagram illustrating a structure of a display apparatus according to one embodiment.

FIG. 1 is a block diagram illustrating a structure of display apparatus 10 according to this embodiment. Display apparatus 10 has a large number of arrayed (n-rows, m-column) pixel circuits 12 (*i, j*) (where, 1<=i<=n and 1<=j<=m), source driving circuit 14, gate driving circuit 16, and power supply circuit 18.

Source driving circuit 14 supplies an image signal voltage Vsg (j) (j represents each of the pixel columns 1 to m, m being the highest number) to each of data lines 20 (*j*). The pixel circuits 12 (1, *j*)-12 (*n, j*), which are aligned in column (j) of the pixel circuit 12, are connected commonly with the data line 20 (*j*).

Gate driving circuit 16 supplies control signals CNT21 (*i*) to CNT24 (*i*) (i represents each of the pixel rows 1 to n, n being the highest number) to each of control signal lines 21(*i*) to 24(*i*). The pixel circuits 12 (*i*, 1)-12 (*i, m*) which are aligned in row (i) of the pixel circuit 12, are connected commonly with the control signal lines 21(*i*)-24(*i*). In this embodiment, four kinds of control signals CNT21 (*i*) to CNT24(*i*) are supplied to one pixel circuit 12 (*i, j*). However, the number of control signals is not limited to four.

Power supply circuit 18 supplies a high-voltage Vdd to power source lines 31 and supplies a low-voltage Vss to power source lines 32. The lines 31 and 32 are connected to all pixel circuits 12 (1, 1) to 12 (*n, m*). The voltages Vdd and Vss are provided so that the organic EL device, described later, can emit light. Reference voltage Vref is supplied to voltage line 33, and initialization voltage Vint is supplied to voltage line 34. The lines 33 and 34 are connected to all of pixel circuits 12 (*i, j*).

Figure 2:
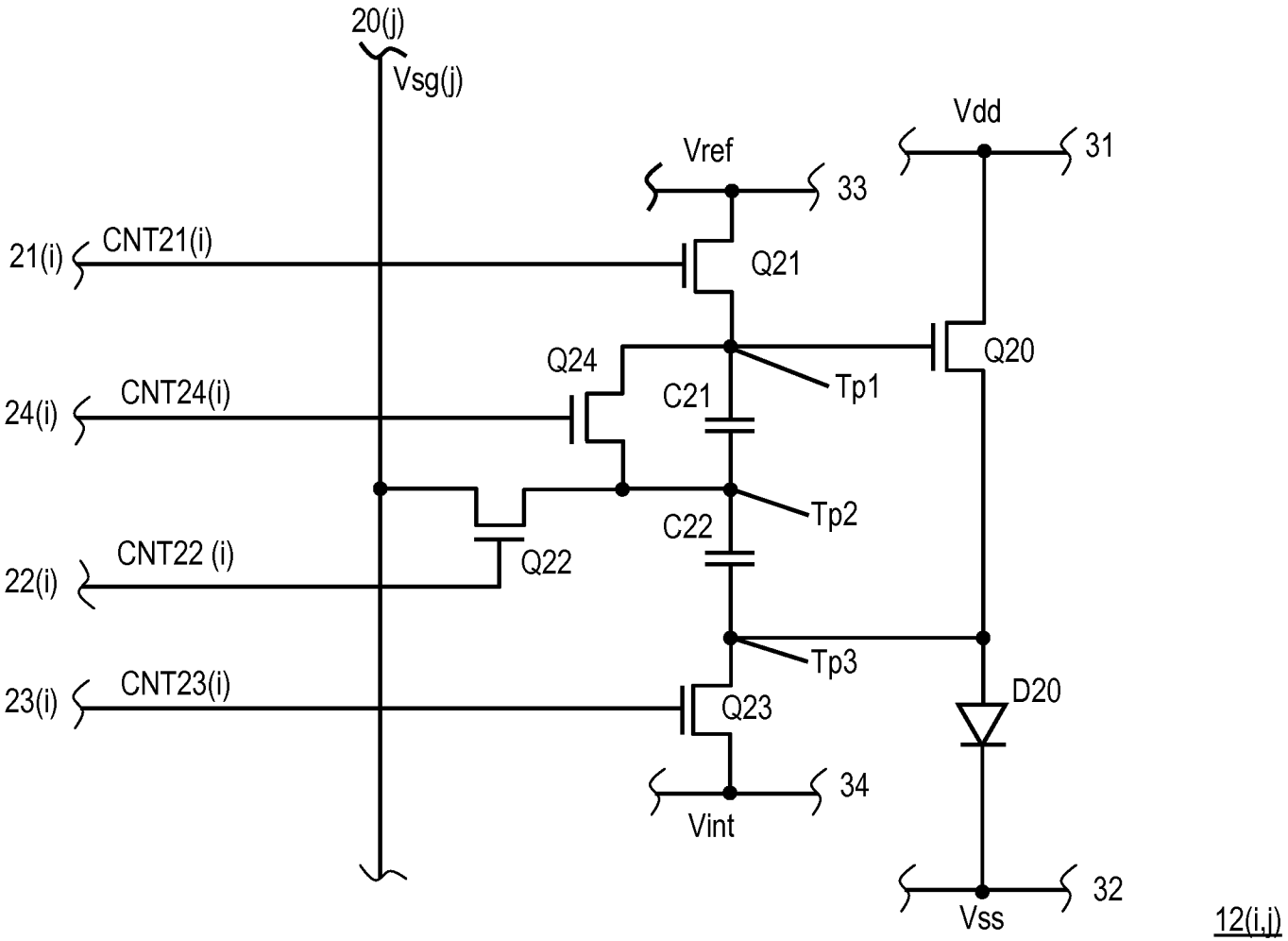
FIG. 2 is a circuit diagram of a pixel circuit of the display apparatus.

FIG. 2 is a circuit diagram of a pixel circuit 12 (*i, j*) of the display apparatus 10. The pixel circuit 12 (*i, j*) has an organic EL device D20, (an example of current light emitting device), driving transistor Q20, first capacitor C21, second capacitor C22, and transistors Q21 to Q24 which operate as switches.

Driving transistor Q20 supplies current to organic EL device D20. First capacitor C21 stores image signal voltage Vsg which varies in response to image signal (j). Second capacitor C22 stores threshold voltage Vth of driving transistor Q20. Transistor Q21 is a switch for applying reference voltage Vref to one terminal of first capacitor C21. Transistor Q22 is a switch for writing (charging) image signal voltage Vsg (j) to first capacitor C21. Transistor Q23 is a switch for applying initialization voltage Vint to one terminal of second capacitor C22. Transistor Q24 is a switch for short-circuiting first capacitor C21.

In this embodiment, all of driving transistor Q20 and transistors Q21 to Q24 are N-channel TFT and enhancement type transistors. However, other types of transistors can be employed. Each of the transistors can be a P-channel TFT, or a depletion type transistor. Further, it is desirable to adopt a transistor having small leakage current in OFF state and having low ON resistance for transistors Q21-Q24 which operate as switches. In this context, "ON resistance" means resistance between a drain electrode and a source electrode of a transistor when the transistor is ON.

Pixel circuit 12 (*i, j*) has a structure that driving transistor Q20 and organic EL device D20 are connected between power source lines 31 and 32. That is, a drain of driving transistor Q20 is connected to power source line 31, a source of driving transistor Q20 is connected to an anode of organic EL device D20, and a cathode of organic EL device D20 is connected to power source line 32.

First capacitor C21 and second capacitor C22 are connected in series between a gate and source of driving transistor Q20. That is, one terminal (first terminal) of first capacitor C21 is connected to the gate of driving transistor Q20, and the other terminal (second terminal) of first capacitor C21 is connected to one terminal of second capacitor C22. The other terminal of second capacitor C22 is connected to the source of driving transistor Q20. Hereafter, a node to which the gate of transistor Q20 and first capacitor C21 are connected is called "node Tp1". A node to which first capacitor C21 and second capacitor C22 are connected is called "node Tp2". Anode to which second capacitor C22 and the source of transistor Q20 are connected is called "node Tp3".

A drain of transistor Q21 (first switch) is connected to voltage line 33 which supplies reference voltage Vref. A source of the transistor Q21 is connected to node Tp1. A gate of the transistor Q21 is connected to control signal line 21(*i*). Transistor Q21 thus applies reference voltage Vref to the gate of driving transistor Q20. The transistor may be a P-channel TFT, instead of an N-channel TFT. When the transistor is P-channel TFT, the position of gate and source are reverse to that of N-channel TFT. The same mechanism can be applied to the transistors (Q22, Q23, Q24) described below.

A drain of transistor Q22 (second switch) is connected to node Tp2. A source of transistor Q22 is connected to data line 20(*j*) which supplies image signal voltage Vsg. A gate of transistor Q22 is connected to control signal line 22(*i*). Transistor Q22 thus supplies image signal voltage Vsg to node Tp2 of first capacitor C21 and second capacitor C22.

A drain of transistor Q23 (third switch) is connected to node Tp3. A source of transistor Q23 is connected to voltage line 34 which supplies initialization voltage Vint. A gate of transistor Q23 is connected to control signal line 23(*i*). Transistor Q23 thus supplies initialization voltage Vint to the source of driving transistor Q20.

A drain of transistor Q24 (fourth switch) is connected to node Tp1. A source of transistor Q24 is connected to node Tp2. A gate of transistor Q24 is connected to control signal line 24(*i*). Transistor Q24 thus short-circuits first capacitor C21.

Control signals CNT21(*i*) to CNT24(*i*) are supplied respectively to control signal lines 21(*i*) to 24(*i*).

As described above, pixel circuit 12 (*i, j*) according to this embodiment has first capacitor C21 having a first terminal connected to a gate of driving transistor Q20;

second capacitor C22 connected between a second terminal of first capacitor C21 and a source of driving transistor Q20;

transistor Q21 (first switch) applying reference voltage Vref to gate of driving transistor Q20;

transistor Q22 (second switch) supplying image signal voltage Vsg to node Tp2 to which the capacitors C21 and C22 are connected to;

transistor Q23 (third switch) supplying initialization voltage Vint to the source of driving transistor Q20, and transistor Q24 (fourth switch) short-circuiting first capacitor C21.

In this embodiment, the minimum voltage between the anode and the cathode of organic EL device D20 is 1(V) (this minimum voltage is called Vled hereafter) when a current flows in the device D20. The capacity between the anode and cathode of organic EL device D20 is 1 (pF) when a current does not flow in the device D20. Threshold voltage Vth of driving transistor Q20 is about 1.5(V). The electric capacity of first capacitor C21 and second capacitor C22 are 0.5 (pF). Regarding the driving voltage, high-voltage Vdd is 10(V), low-voltage Vss is 0(V), reference voltage Vref is 1(V), and initialization voltage Vint is −1(V).

However, these values can be changed according to the specification of the display apparatus or characteristics of each device. Thus, the driving voltage can be optimally set according to the specification of the display apparatus or characteristic of the devices.

Figure 3:
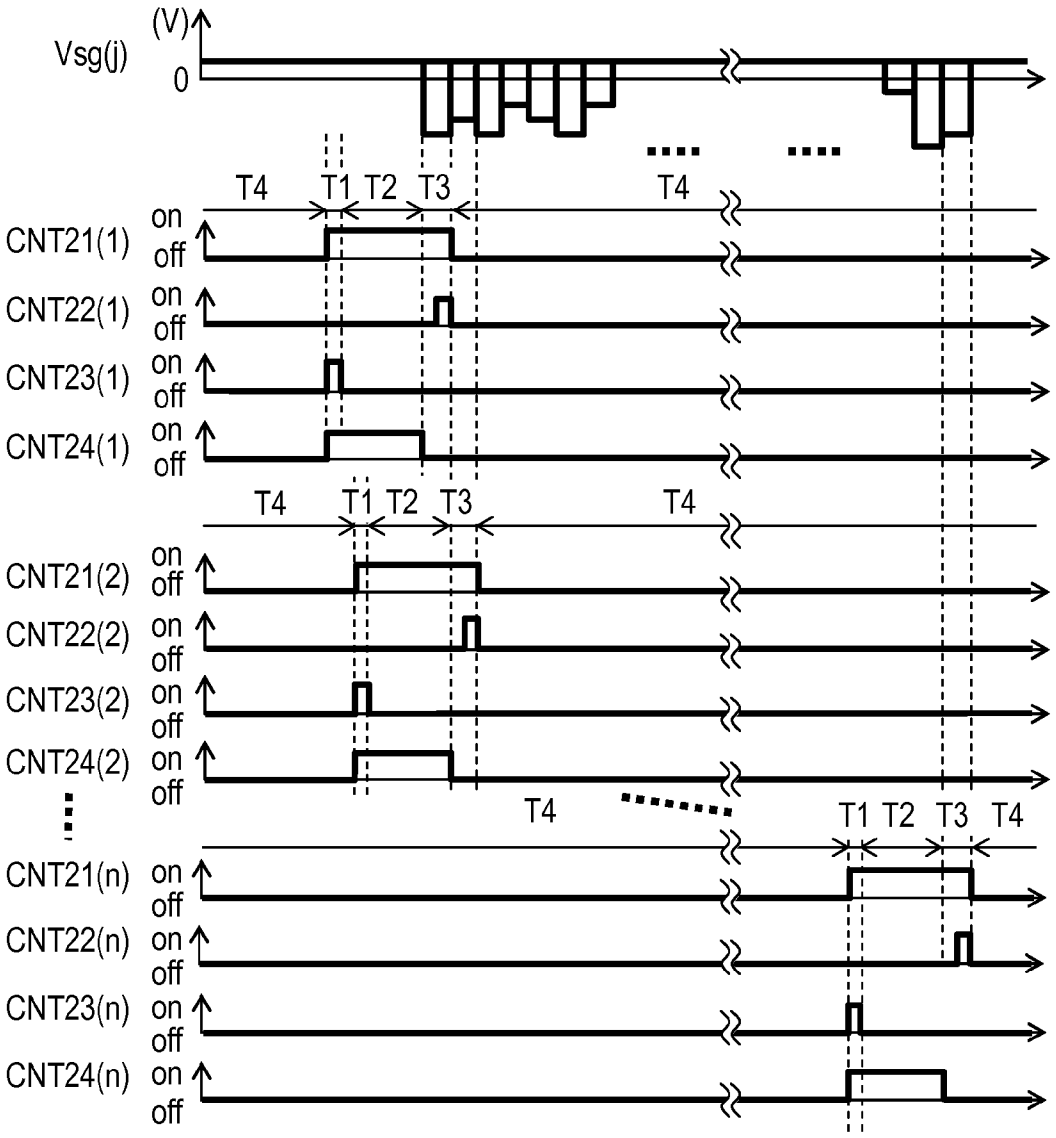
FIG. 3 is a timing diagram illustrating an operation of the display apparatus.

Next, an operation of pixel circuit 12 (*i, j*) of this embodiment is described. FIG. 3 is a timing diagram illustrating an operation of display apparatus 10 in this embodiment.

As shown in FIG. 3, one frame period is divided into four periods (i.e. initialization period T1, threshold detecting period T2, writing period T3, and luminescence period T4) in order to control organic EL devices D20 in each of the pixel circuits 12 (*i,j*).

In initialization period T1, second capacitor C22 is charged to a predetermined voltage.

In threshold detecting period T2, threshold voltage Vth of driving transistor Q20 is detected and then threshold voltage Vth is charged to second capacitor C22.

In writing period T3, image signal voltage Vsg, corresponding to the image signal (j), is written (charged) to first capacitor C21.

In luminescence period T4, a sum of terminal to terminal voltage of first capacitor C21 and terminal to terminal voltage of second capacitor C22 is applied between the gate and source of driving transistor Q20 in order to generate a current-flow in organic EL device D20 and to emit light from the device D20.

Hereafter, the terminal to terminal voltage of first capacitor C21 is referred to as voltage V21, and the terminal to terminal voltage of second capacitor C22 is referred to as voltage V22.

The timing of these four periods are set so that the pixel circuits belonging in the same row (i), (i.e. pixel circuits 12 (*i*, 1) to 12 (*i, m*)) operates with substantially same timings. Meanwhile, the timings of writing period T3 are set so that the period T3 in the different rows does not overlap each other. Accordingly, while a writing operation is being performed on one pixel row, the other pixel rows can execute an operation other than the writing. Thus, driving period can be used efficiently.

Figure 4:
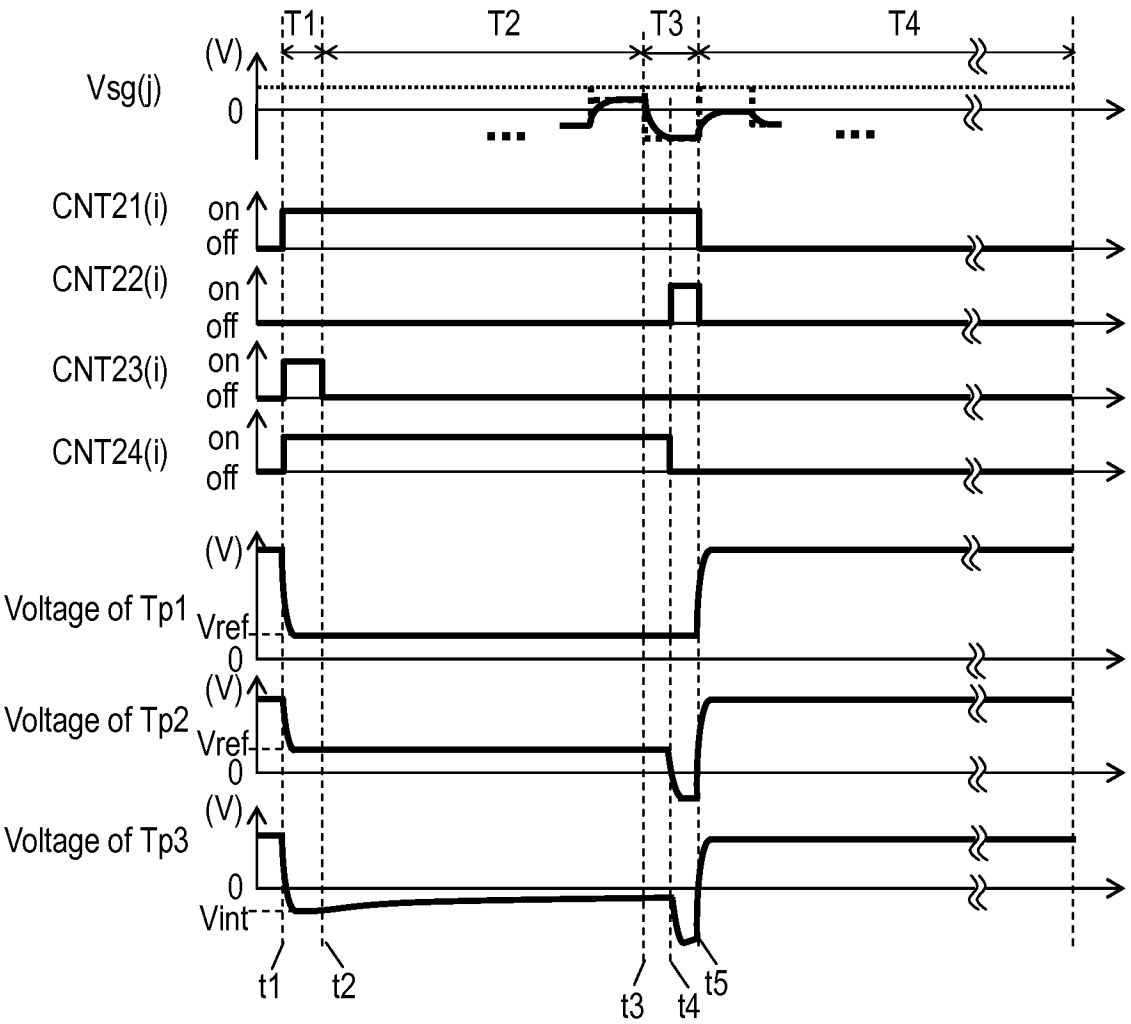
FIG. 4 is a timing diagram illustrating an operation of the pixel circuit in the display apparatus.

FIG. 4 is a timing diagram illustrating an operation of pixel circuit 12 (*i, j*) of display apparatus 10 according to the first embodiment. In FIG. 4, changes of the voltages in nodes Tp1 to Tp3 are also illustrated. The operation of pixel circuit 12 (*i, j*) is detailed hereafter for each of the divided periods.

Initialization Period T1

Figure 5:
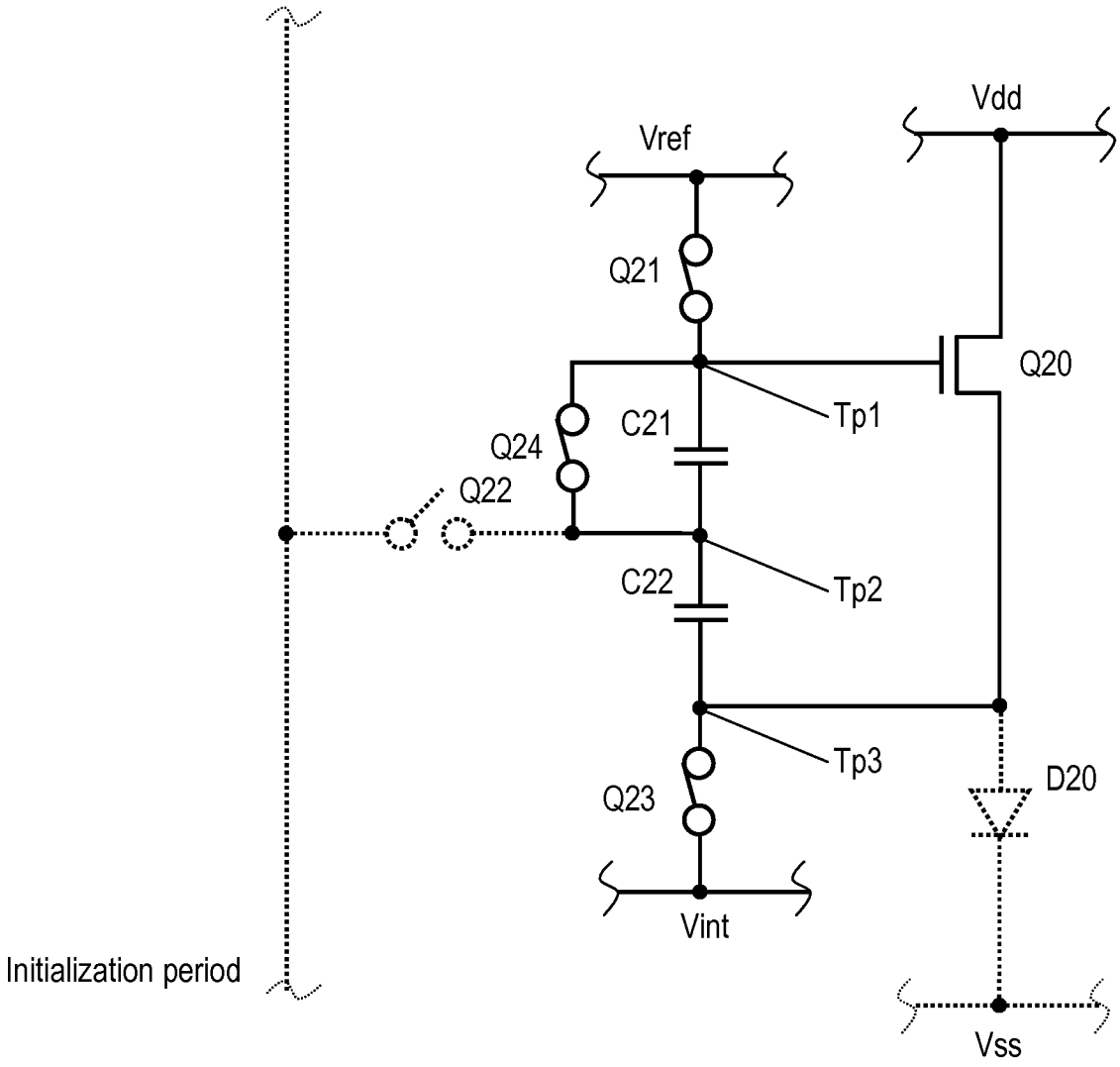
FIG. 5 is a circuit diagram for illustrating an operation of the pixel circuit during an initialization period.

FIG. 5 is a circuit diagram for illustrating an operation of pixel circuit 12 (*i, j*) during initialization period T1. In FIG. 5, the transistors Q21 to Q24 (of FIG. 2) are shown by symbols of switches. The path through which current does not flow is shown in dotted line.

At time t1, while control signal CNT22(*i*) is set to low level to set transistor Q22 OFF, control signals CNT24(*i*), CNT21 (*i*), and CNT23(*i*) are set to high level to set transistors Q24, Q21, and Q23 ON. Reference voltage Vref is thereby applied to node Tp1 via transistor Q21, and to node Tp2 via transistor Q24. Initialization voltage Vint is applied to node Tp3 via transistor Q23.

Reference voltage Vref is set to a voltage lower than a sum of low-voltage Vss and voltage Vled, i.e. Vref<Vss+Vled. Accordingly, organic EL device D20 does not emit light during initialization period T1 because source voltage of driving transistor Q20 is lower than voltage (Vss+Vled).

Initialization voltage Vint is set to a voltage such that the difference from reference voltage Vref is larger than threshold voltage Vth of driving transistor Q20, i.e. Vref−Vint>Vth. When transistors Q21, Q24 and Q23 are set to ON, voltage Vref is applied to first terminal, and voltage Vint is applied to second terminal of second capacitor C22. That is, voltage (Vref−Vint) is charged to second capacitor C22. Accordingly, the voltage (Vref−Vint) is applied between the gate and source of driving transistor Q20. Since the voltage (Vref−Vint) is higher than threshold voltage Vth of driving transistor Q20, a current is supplied from the power supply of high-voltage Vdd to the power supply of initialization voltage Vint via driving transistor Q20 and transistor Q23.

In this embodiment, initialization period T1 is set to 1 micro second.

Threshold Detection Period T2

Figure 6:
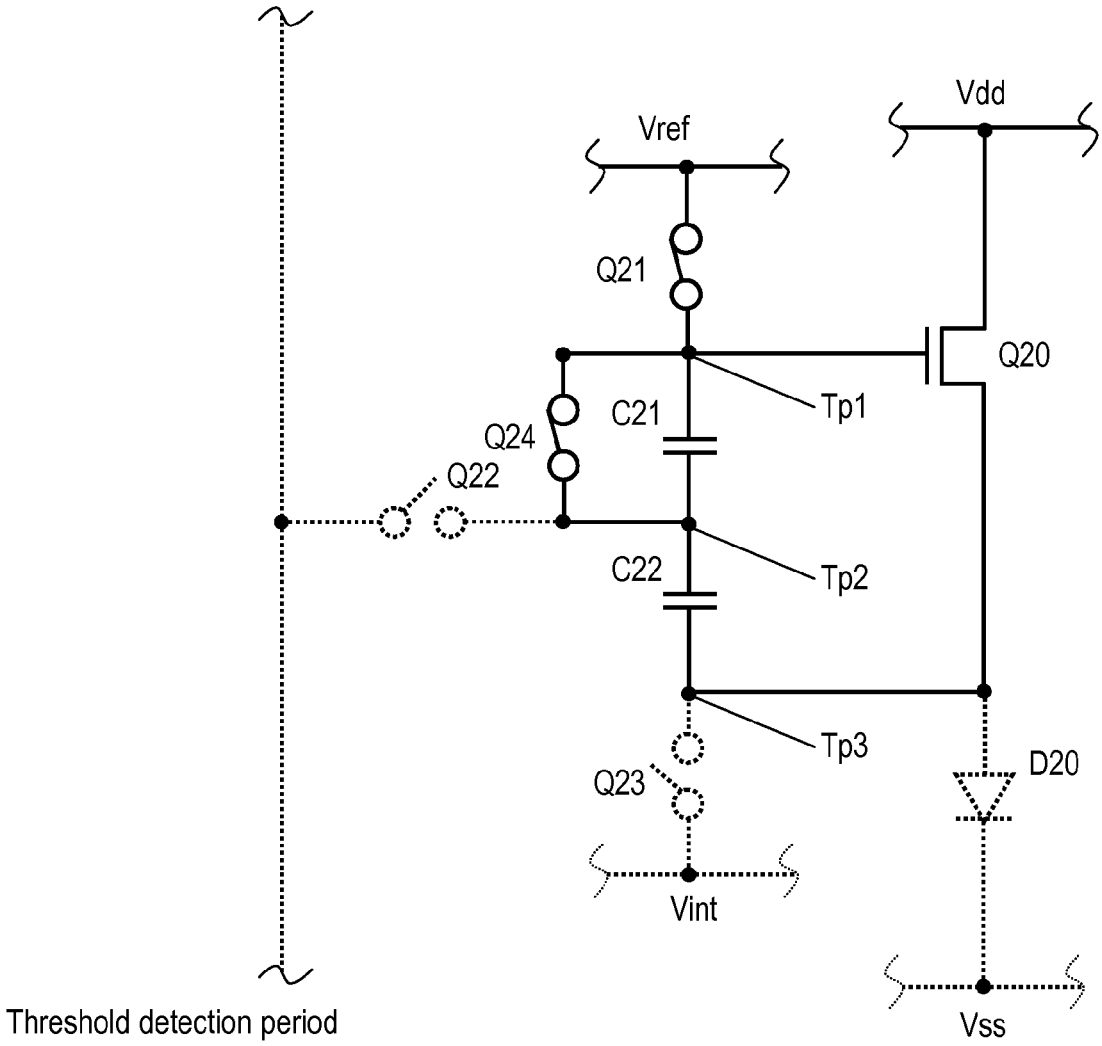
FIG. 6 is a circuit diagram for illustrating an operation of the pixel circuit during a threshold detecting period.

FIG. 6 is a circuit diagram for illustrating an operation of pixel circuit 12 (*i, j*) during threshold detection period T2.

At time t2, control signal CNT23(*i*) is set to low level to set transistor Q23 OFF. At this point, the current flows continuously in driving transistor Q20 because voltage V22, which is larger than threshold voltage Vth of driving transistor Q20, is applied between the gate and source of driving transistor Q20. Due to this current, second capacitor C22 is discharged and voltage V22 starts decreasing.

While voltage V22 is higher than threshold voltage Vth, current keeps flowing in transistor Q20 although the amount of the current continues to decrease. Voltage V22 thereby decreases gradually to threshold voltage Vth. When voltage V22 falls to threshold voltage Vth, the current in driving transistor Q20 stops flowing and the voltage V22 also stops decreasing.

The current flowing in driving transistor Q20 decreases as voltage V22 decreases because driving transistor Q20 operates as a current source which is controlled by the voltage applied between the gate and source of driving transistor Q20. As a result, a long time is required before voltage V22 falls to threshold voltage Vth. Moreover, the longtime requirement is further caused because the large electric capacity of organic EL device D20 is added to the electric capacity of second capacitor C22. Practically, this takes 10 to 100 times longer than the case of discharging the capacitor by transistor-switching. For this reason, threshold detection period T2 is set to 10 micro seconds in this embodiment.

Writing Period T3

Figure 7:
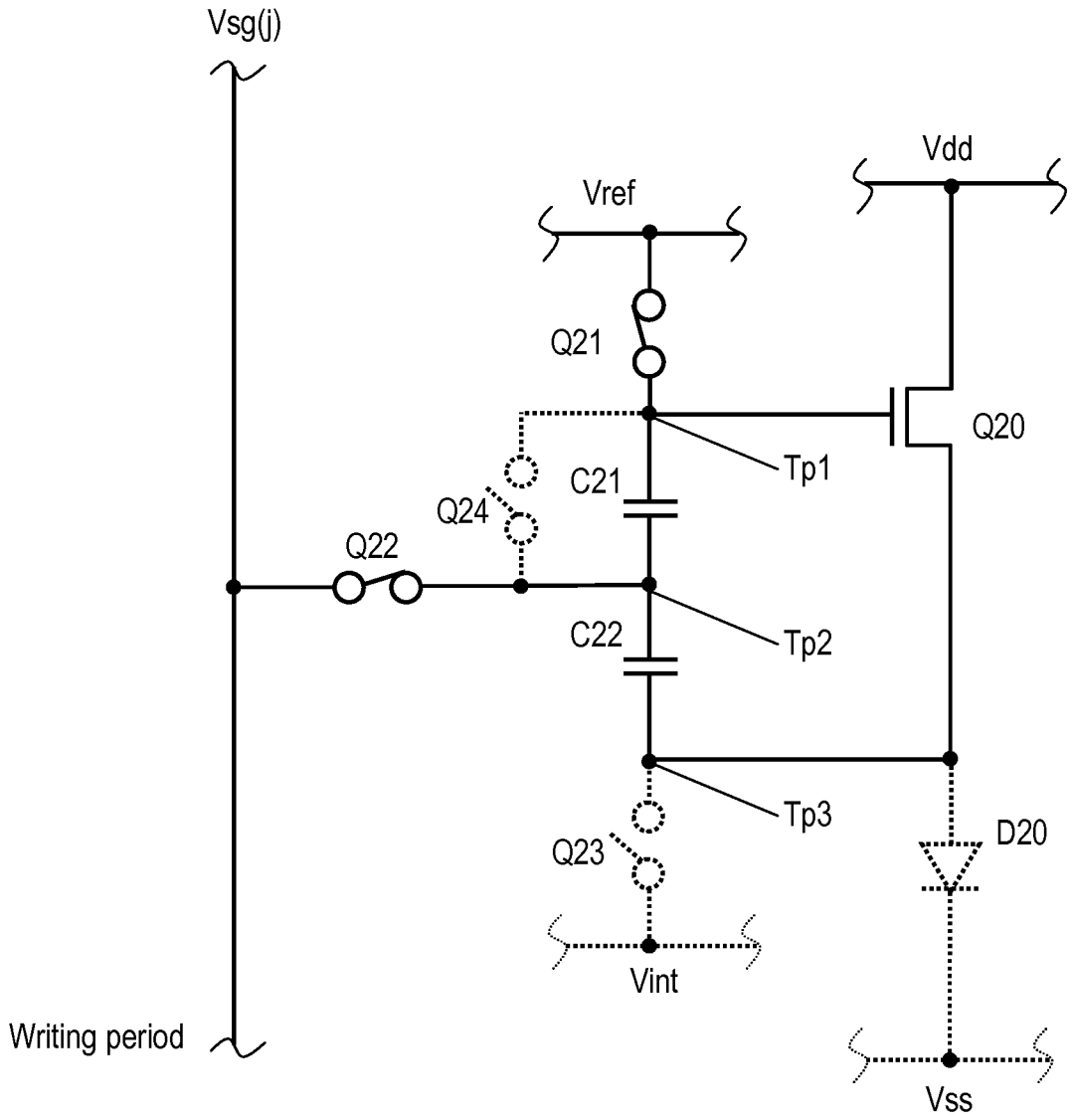
FIG. 7 is a circuit diagram for illustrating an operation of the pixel circuit during a writing period.

FIG. 7 is a circuit diagram for illustrating an operation of pixel circuit 12 (*i, j*) during writing period T3.

At time t3, image signal voltage Vsg (j) corresponding to the image signal, which is to be displayed, is supplied to data line 20 (*j*). However, as shown in FIG. 4, a substantial time is required before the voltage Vsg (j) being stable because data line 20 (*j*) has a rather large equivalent capacity and data line 20 (*j*) itself has a substantial amount of impedance.

At time t4, where image signal voltage Vsg (j) becomes stable, control signal CNT24(*i*) is set to low level to set transistor Q24 OFF. Then control signal CNT22(*i*) is set to high level to set transistor Q22 ON. As a result, the voltage of node Tp2 turns to image signal voltage Vsg (j), and the voltage (Vref−Vsg) is charged between two terminals of first capacitor C21. Hereafter, this voltage (Vref−Vsg) is indicated as image signal voltage Vsg'.

At this point, voltage (Vsg'+Vth) is applied between the gate and source of driving transistor Q20. This voltage is equivalent to a sum of the voltages charged in the first capacitor C21 and the second capacitor C22 (i.e. image signal voltage Vsg' is charged to the capacitor C21; and threshold voltage Vth is charged to the capacitor C22). While image signal voltage Vsg' is larger than zero, current flows in driving transistor Q20 because the voltage applied between the gate and source of driving transistor Q20 is higher than threshold voltage Vth of the transistor Q20. Due to this current, voltage V22 decreases.

In this embodiment, writing period T3 is set to 2 micro seconds. Assuming that time before image signal voltage Vsg (j) being stable is 1 micro second, the time for charging first capacitor C21 (by setting transistor Q22 ON) is set to 1 micro second. Since the time when transistor Q22 stays ON is set short, voltage V22 decreases a little during this period T3.

Luminescence Period T4

Figure 8:
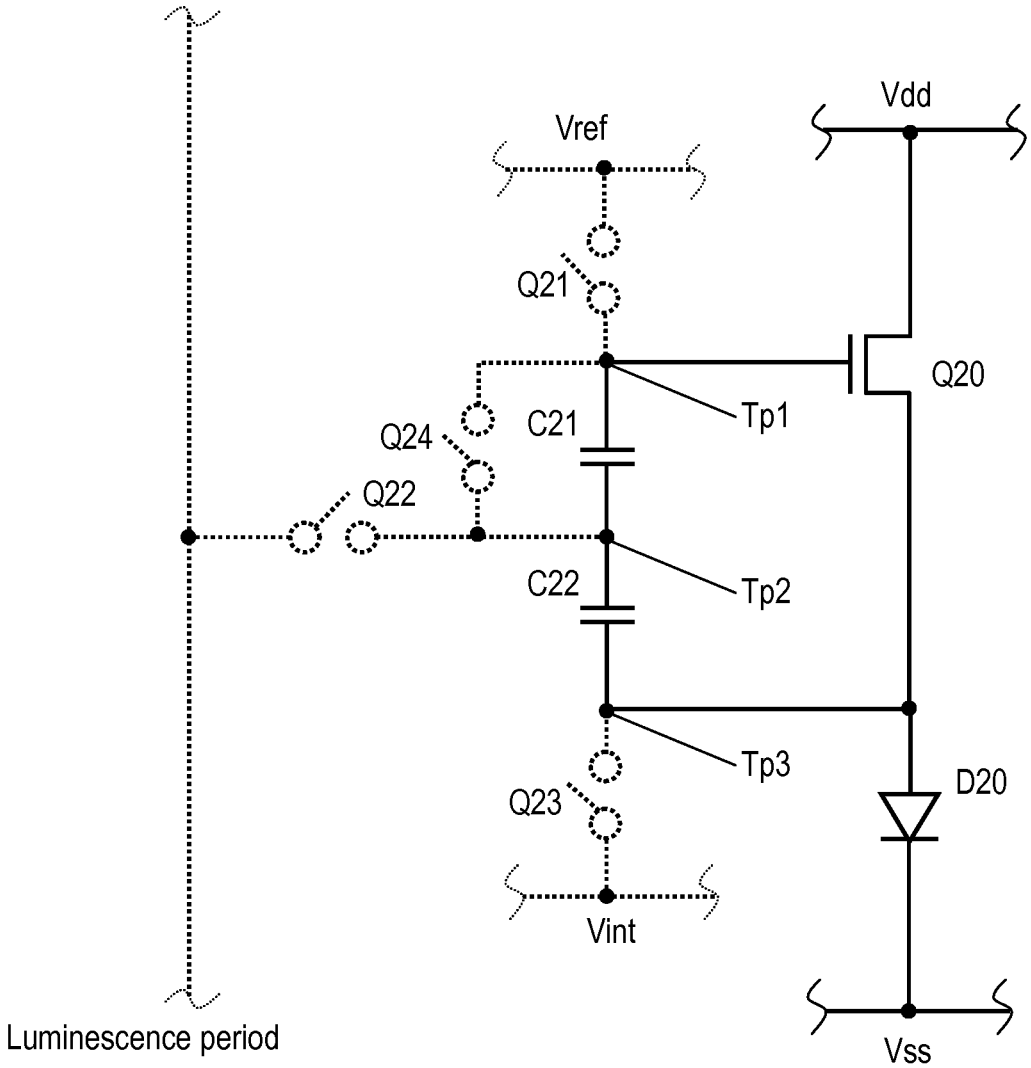
FIG. 8 is a circuit diagram for illustrating an operation of the pixel circuit during a luminescence period.

FIG. 8 is a circuit diagram for illustrating an operation of pixel circuit 12 (*i, j*) during luminescence period T4.

At time t5, control signal CNT22(*i*) is set to low level to set transistor Q22 OFF. Control signal CNT21(*i*) is set to low level to set transistor Q21 OFF. Consequently, nodes Tp1 to Tp3 temporarily enter a floating state and voltage (Vsg'+Vth), that is larger than threshold voltage Vth, is applied between the gate and source of driving transistor Q20. Accordingly, a current corresponding to the voltage applied between the gate and source of driving transistor Q20 is supplied to organic EL device D20.

At this point, current (I) satisfies $$I=K*(VGS-Vth)=K*Vsg'$$

where,

VGS: voltage applied between the gate and source of the transistor Q20,

K: a constant value.

This equation is free from threshold voltage Vth.

As discussed above, current flowing in organic EL device D20 is not influenced by threshold voltage Vth. Therefore, the current flowing in the device D20 is free from being affected by dispersion of threshold voltage Vth of driving transistor Q20. Even when threshold voltage Vth changes with the time, organic EL device D20 can emit a light with luminosity corresponding to the image signal.

After luminescence period T4, a non-light emitting period can be provided. This period can be achieved by setting one of the transistors Q24, Q21, and Q23 ON.

During threshold detection period T2, it is desirable to set transistor Q24 ON. However, if the leakage current of first capacitor C21 is negligible, transistor Q24 can be set to OFF. In this case, control signals CNT24(*i*) and CNT23(*i*) can be shared because transistors Q23 and Q24 can be controlled by the same signal throughout these four period.

As described above, one-frame period is divided into initialization period T1, threshold detecting period T2, writing period T3, and luminescence period T4 in this embodiment.

In initialization period T1, transistor Q22 (second switch) is set to OFF, while transistors Q21 (first switch), Q23 (third switch), and Q24 (fourth switch) are set to ON. The voltage (Vref−Vint) is thereby applied to second capacitor C22.

Next, in threshold detecting period T2, transistors Q22 (second switch) and Q23 (third switch) are set to OFF, while transistors Q21 (first switch) and Q24 (fourth switch) ON are set to ON. A closed-circuit including second capacitor C22 and driving transistor Q20 is thereby formed, and the current in transistor Q22 is decreased.

In subsequent writing period T3, transistors Q23 and Q24 are set to OFF, while transistors Q21 and Q22 are set to ON. Voltage (Vref−Vsg) is thereby applied to first capacitor C21.

Then in luminescence period T4, transistors Q21, Q22, Q23 and Q24 are set to OFF. The current corresponding to the image signal voltage Vsg is thereby supplied to organic EL device D20 (current light emitting device) and driving transistor Q20. The device D20 thus emits light for displaying an image.

As described above, the driving method of the display apparatus according to this embodiment allows the threshold voltage of the driving transistor to be detected independently of image signal voltage Vsg (j). Writing period T3 can be thereby shortened, as long as the writing period T3 is larger than a sum of a time needed for determining image signal voltage Vsg (j) and a time needed for charging first capacitor C21 (by turning transistor Q22 ON).

This embodiment allows high speed writing, and thereby achieves a display apparatus that has a large number of pixels and high definition.

In the embodiment, each of the numerical values, e.g. voltage is an exemplary value, and these values are preferably set according to the characteristics of organic EL device or the display apparatus.

INDUSTRIAL APPLICABILITY

The present disclosure is useful as a driving method for an active-matrix display device employing a current light emitting device.

The invention claimed is:

1. A driving method of a display apparatus including a plurality of arrayed pixel circuits, each of the pixel circuits including:

a current light emitting device;

a driving transistor supplying current to the current light emitting device;

a first capacitor having a first terminal connected to a gate of the driving transistor;

a second capacitor connected between a second terminal of the first capacitor and a source of the driving transistor;

a first switch applying a reference voltage to the gate of the driving transistor;

a second switch supplying an image signal voltage to a node at which the first and the second capacitors are connected;

a third switch supplying an initialization voltage to the source of the driving transistor, and a fourth switch configured to short circuit the first capacitor, the driving method comprising:

(a) dividing one-frame period into an initialization period, a threshold detection period, a writing period, and a luminescence period;

(b) applying, in the initialization period, a first differential voltage, defined by a difference between the reference voltage and the initialization voltage, to the second capacitor by setting the second switch OFF, and setting the first, third and fourth switches ON;

(c) reducing, in the threshold detection period, the voltage of the second capacitor by closing a current path formed by the second capacitor and the driving transistor, where the current path is closed by setting second and third switches OFF and first and fourth switches ON;

(d) applying, in the writing period, a second differential voltage, defined by a difference between the reference voltage and the image signal voltage, to the first capacitor by setting the third and fourth switches OFF and first and second switches ON, and (e) applying, in the luminescence period, a current to the driving transistor and the current light emitting device corresponding to the image signal voltage, by setting first, second, third and fourth switches OFF.

2. The driving method of a display apparatus according to claim 1, wherein the reference voltage is set to a voltage which is lower than the sum of a low voltage, Vss, and a voltage, Vled, which is the minimum voltage between an anode and a cathode of the current light emitting device when current flows through the current light emitting device.

3. The driving method of a display apparatus according to claim 1, the initialization voltage is set such that the difference between the initialization voltage and the reference voltage is larger than a threshold voltage of the driving transistor.

* * * * *